US005156683A

United States Patent [19]

Ross

[11] Patent Number: 5,156,683

[45] Date of Patent: Oct. 20, 1992

[54] APPARATUS FOR MAGNETIC INDUCTION EDGE HEATERS WITH FREQUENCY MODULATION

[75] Inventor: Nicholas V. Ross, Youngstown, Ohio

[73] Assignee: Ajax Magnethermic Corporation, Warren, Ohio

[21] Appl. No.: 514,852

[22] Filed: Apr. 26, 1990

[51] Int. Cl.[5] ..... B05C 11/02

[52] U.S. Cl. ..... 118/620; 118/58; 118/429; 219/10.47; 219/10.61 R; 427/543

[58] Field of Search ..... 118/50.1, 58, 620, 641, 118/429; 427/46, 321; 72/202; 219/10.61 R, 10.47

[56] References Cited

U.S. PATENT DOCUMENTS

| | | | |
|---|---|---|---|
| 2,873,344 | 7/1956 | Kocks et al. | 219/10.43 |
| 4,357,512 | 11/1982 | Nishimoto et al. | 219/8.5 |
| 4,627,259 | 12/1986 | Andersson et al. | 72/202 |
| 4,761,530 | 8/1988 | Scherer et al. | 219/10.71 |
| 4,775,772 | 11/1988 | Chaboseau | 219/10.61 R |
| 4,778,971 | 10/1988 | Sakimoto et al. | 219/10.61 R |
| 4,795,872 | 1/1989 | Hagisawa et al. | 219/10.61 R |
| 4,807,559 | 2/1989 | Sommer et al. | 118/63 |
| 4,810,843 | 3/1989 | Wicker et al. | 219/10.43 |
| 4,845,332 | 7/1989 | Jancosek et al. | 118/620 X |

FOREIGN PATENT DOCUMENTS 47-9253-R 3/1972 Japan .

*Primary Examiner*—Richard L. Chiesa

*Attorney, Agent, or Firm*—Fay, Sharpe, Beall, Fagan, Minnich & McKee

[57] ABSTRACT

An apparatus for galvannealing steel strip includes an applying device for applying a coating of controlled thickness of a strip. A controller controls the thickness of the applied coating. A heating furnace heats the steel strip to produce a galvannealed product. Edge heaters for heating the edges of the steel strip by magnetic induction promote uniform temperature distribution across the steel strip. The uniform temperature distribution produces more uniform galvannealing in the product. The edge heaters have preselected operating frequencies. A modulating circuit imposes a frequency modulation on the operating frequencies of the edge heaters to avoid undesirable transverse flexural resonance in the galvannealed product.

3 Claims, 5 Drawing Sheets

APPARATUS FOR MAGNETIC INDUCTION EDGE HEATERS WITH FREQUENCY MODULATION

BACKGROUND OF THE INVENTION

1. Field of the Invention

This invention pertains to the art of induction heating and more particularly to a method and apparatus to uniformally galvanneal edges of coated strip steel.

2. Description of Related Art

Galvanizing is the coating of iron or steel products with zinc to inhibit rust. Galvannealing is the process of further treating a zinc-coated steel strip for forming an extended iron-zinc alloy. A galvannealed product has a number of advantages over a galvanized product, e.g. easier spot welding and better paintability.

The galvannealing process essentially consists of submerging a clean, preheated steel strip in a bath of liquid zinc or zinc-rich alloy. As the strip emerges from the bath, it passes through a coating control system, such as an air knife, which is used to control the thickness of the zinc coating. The coated steel strip is then reheated in a galvannealing furance to produce further intermetallic diffusion between the zinc and steel substrate. A galvannealing furnace is typically fuel fired, but it is also known that the heating may be done electrically by induction heating coils.

There are at least two types of galvannealed products: one has equal coating on either side of the steel strip, the other is described as an "AB product" and has a different coating thickness or "weight" on each surface. The different coating weight is controlled by adjustment of the air knife. In an AB product, essentially all the free zinc is removed from one surface while the other surface has various coating weights remaining.

A particular problem which has been encountered with galvannealing in installations that employ induction heating coils is the occurrence of lines or stripes in the coated steel product. The stripes appearing in the finished product are typically parallel to the direction of movement of the strip through the furnace. Occurrence of the stripes is coincident with an audible noise so that the characteristic has been referred to as "noise stripes." The stripes are actually evidence of a resonant response in the strip to the induction heating field of the induction heating coils. U.S. Pat. No. 4,807,559 to Sommer, et al. discloses an induction heating furnace wherein the operating frequency of the heating coils is modulated to avoid a resonant vibration in the steel strip.

Because steel strip will often be cooled faster at the edges than in the middle, non-uniformities in the galvannealing process are introduced. Such non-uniformities are thought to be introduced by the air knives. This heat transfer phenomenon of the edges of a strip being cooled faster than the middle of the strip introdues non-uniformities in the strip. Designers have sought to minimize or eliminate this problem through a variety of mechanisms. In U.S. Pat. No. 4,627,259 to Anderson, et al., an edge region heating device is disclosed for use in the hot rolling of a metallic strip after some cooling of the strip has occurred. The device employs an induction heater to preferentially raise the temperature of the edge regions of the strip to compensate for the faster cooling of these regions. Similarly, Japanese Patent No. 7209253 discloses a strip rolling apparatus in which the edges of the strip are maintained at the correct temperature by passing through induction coils.

The above-referenced edge region heating devices may suffer from noise stripes just as a larger galvannealing induction furnace normally would. The present invention contemplates a new and improved method and apparatus to overcome the above-referred to problem and others.

SUMMARY OF THE INVENTION

In accordance with the present invention, there is provided a new and improved apparatus for galvannealing a steel strip.

More particularly, in accordance with the invention, an apparatus for galvannealing a steel strip comprises a means for applying a coating of controlled thickness to a steel strip. The thickness of the applied coating is controlled with an air knife. A furnace heats the steel strip by magnetic induction or with conventional fuels to produce a galvannealed product. The apparatus further comprises edge heaters for heating the edges of the steel strip by magnetic induction to maintain uniform temperature distribution across the steel strip. The furnace and the edge heaters have a preselected operating frequency and modulating means for imposing a frequency modulation on the operating frequency whereby undesirable transverse flexural resonance in the galvannealed product is avoided.

In accordance with another aspect of the invention, the modulating means for imposing the frequency modulation comprises an oscillating circuit including variable components.

According to another aspect of the invention, the modulating means for imposing the frequency modulation comprises an oscillating circuit including a variable inductor.

In another aspect of the invention, the oscillating circuit includes a variable capacitor.

In still another embodiment of the invention, the modulating means comprises a power supply with a modulating operating frequency.

According to another aspect of the invention, the modulating means comprises circuit means for imposing a phase modulation on the operating frequency.

According to another aspect of the invention, the edge heaters are selectively translatable perpendicular to the centerline of the strip. According to one embodiment of the invention, the edge heaters are selectively translatable perpendicular to the centerline of the strip via electric motors.

According to another aspect of the invention, a method is provided for galvannealing a steel strip comprising the steps of applying a coating of zinc to the steel strip, the zinc having a selectively controlled thickness, heating the steel strip in an induction furnace, heating edge portions of the steel strip with edge heating induction coils disposed about the edge portions and operating at an operating frequency, wherein the edge heating coils are positioned relative to the strip to produce a uniform temperature distribution across the steel strip, and modulating the operating frequency of the edge heating coils to impose a frequency modulation on the operating frequency whereby undesirable resonance lines in galvannealed product can be avoided.

According to another aspect of the invention, the edge heating coils are spaced from the edges of the steel strip to maintain uniform temperature distribution across the steel strip.

According to a still further aspect of the invention, a method for galvannealing steel strip comprises selectively translating the edge heating coils perpendicular to the centerline of the steel strip.

DESCRIPTION OF THE PREFERRED EMBODIMENT

Figures 1, 5, 6:
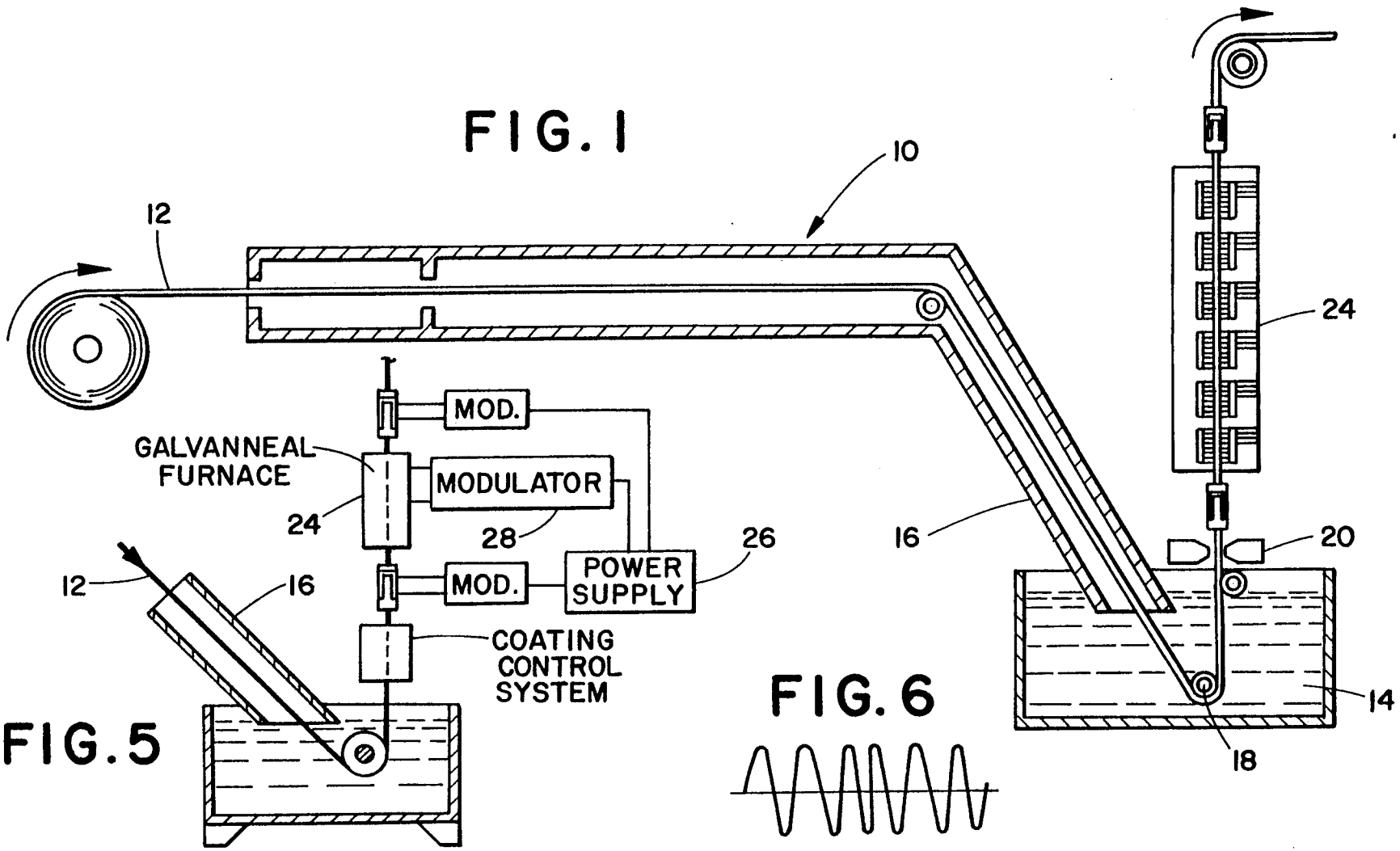
FIG. 1 is a schematic side view of galvannealing apparatus formed in accordance with the present invention.
FIG. 5 is a schematic representative of a galvannealing process and apparatus formed in accordance with the present invention.
FIG. 6 is a graphical representation of a modulated operating frequency such as may be employed in a heating coil of an induction heating galvannealing furnace by a power supply. The modulation is exaggerated for purposes of illustration.

Referring now to the drawings wherein the showings are for purposes of illustrating preferred embodiments of the invention only, and not limitations thereof, FIG. 1 shows a galvannealing assembly 10 wherein a clean, preheated steel strip 12 is submerged in a coating bath 14 essentially comprised of liquid zinc. The strip is directed to the bath through a snout 16 and about a guide wheel 18. After emerging from the bath, the coating strip is directed to a coating control system 20, conventionally comprising an air knife for selectively controlling the thickness of the coating on the strip. In the preferred embodiment, the strip emerging from the coating control system is an AB product in which the coating has been applied to the strip in a manner consistent with conventional galvanizing processes. In conventional induction heating applications, subsequent to emerging from the coating control system, the strip is passed through a galvanneal furnace 24 to enhance the depth of formation of an iron-zinc alloy at the interface of the coating with the strip material as a result of the additional time the strip spends at the elevated temperature. In applications utilizing the present invention, edge coils 34, 36 may be placed before or after the galvanneal furnace.

Although this specification describes the invention with reference to a preferred embodiment that uses a zinc coating, it is within the scope of the invention to use other rust inhibiting coatings such as aluminum that may be heated with induction heating techniques.

Figure 2:
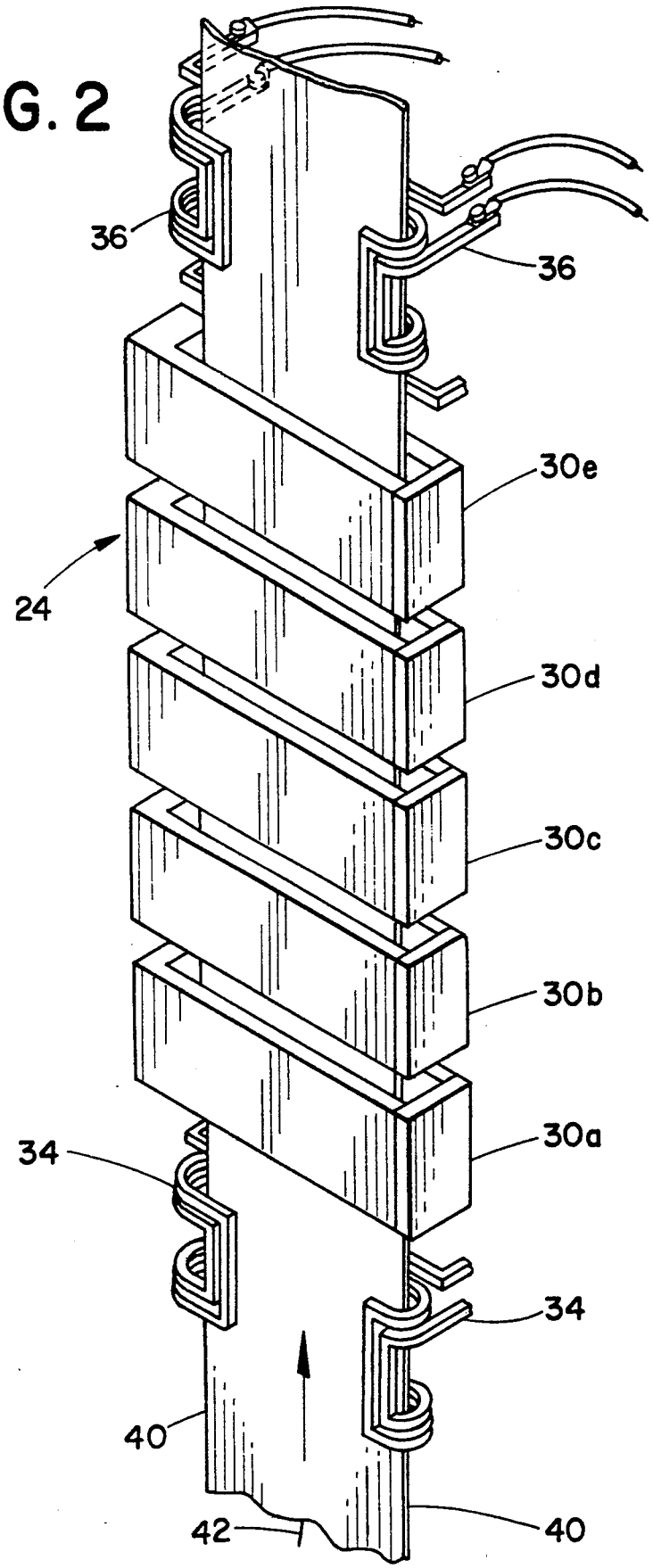
FIG. 2 is perspective view of a galvannealing apparatus formed in accordance with the present invention.

With reference to FIG. 2, a galvanneal furnace 24 is shown comprising five induction coil assemblies 30*a*, 30*b*, 30*c*, 30*d*, and 30*e*. The number of induction coil assemblies will vary depending on the application. A pair of edge heating coils 34 are mounted before the first induction coil assembly. A second pair of edge heating coils 36 are located after the last induction coil assembly 30*e*. This particular arrangement of edge heating coils is not necessary to practice the invention; multiple edge heating coils can be placed before or after the induction furnace. Cooling will occur faster at the edges of the strip 40 than in the center 42. This cooling may be attributed to factors such as the use of air knives 20. Because the galvannealing process is dependent on the temperature of the strip, this non-uniform temperature across the width of the strip leads to non-uniformities in the galvannealing process and eventually in the steel strip itself. The pairs of edge heating coils 34, 36 are effective in reheating or preheating the edges of the strip to provide a more uniform temperature distribution across the width of the strip which results in more uniform galvannealing and, therefore, a more uniform product.

Figure 3:
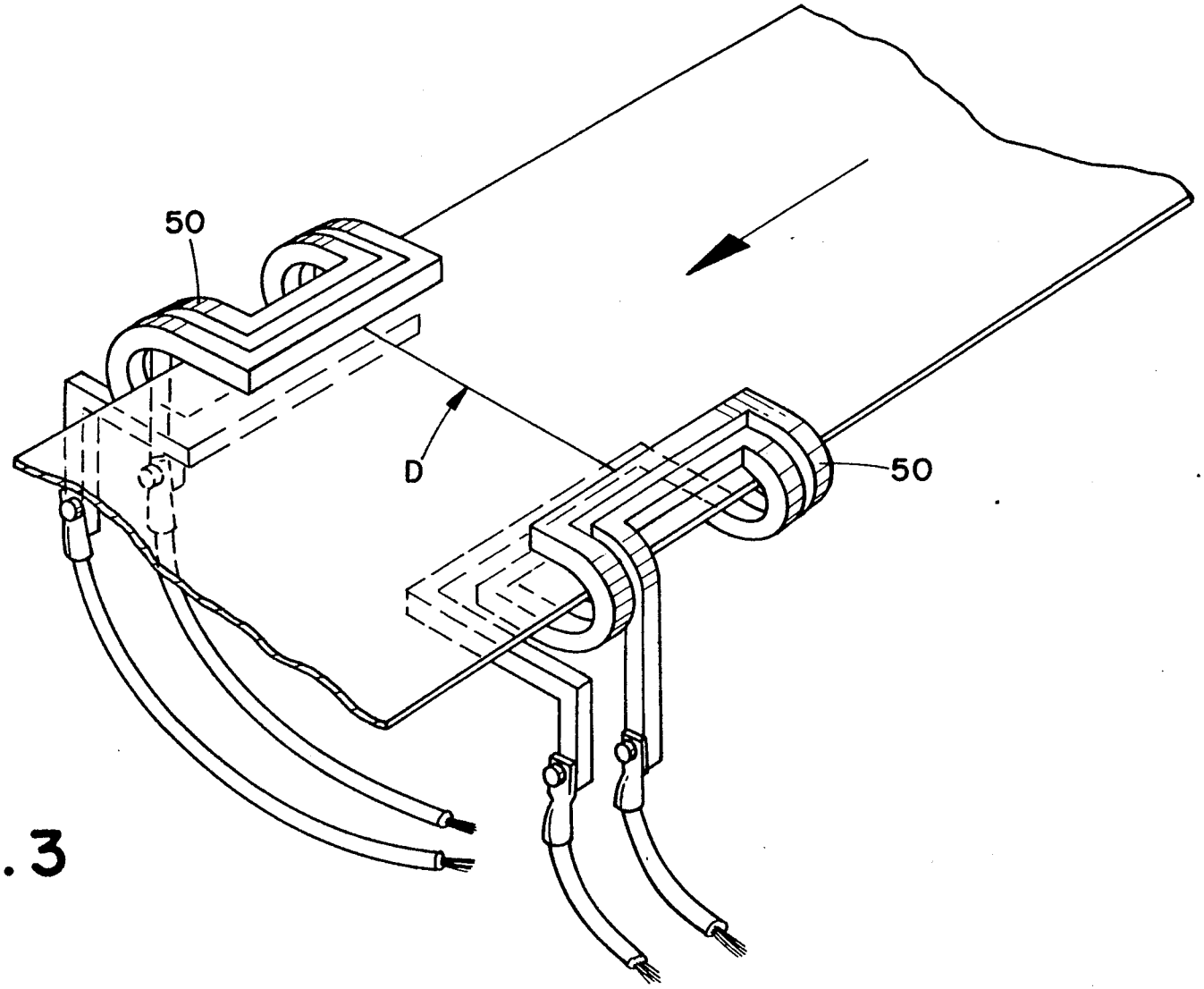
FIG. 3 is a schematic perspective view of a steel strip passing through edge heating coils according to one embodiment of the invention.
Figure 4:
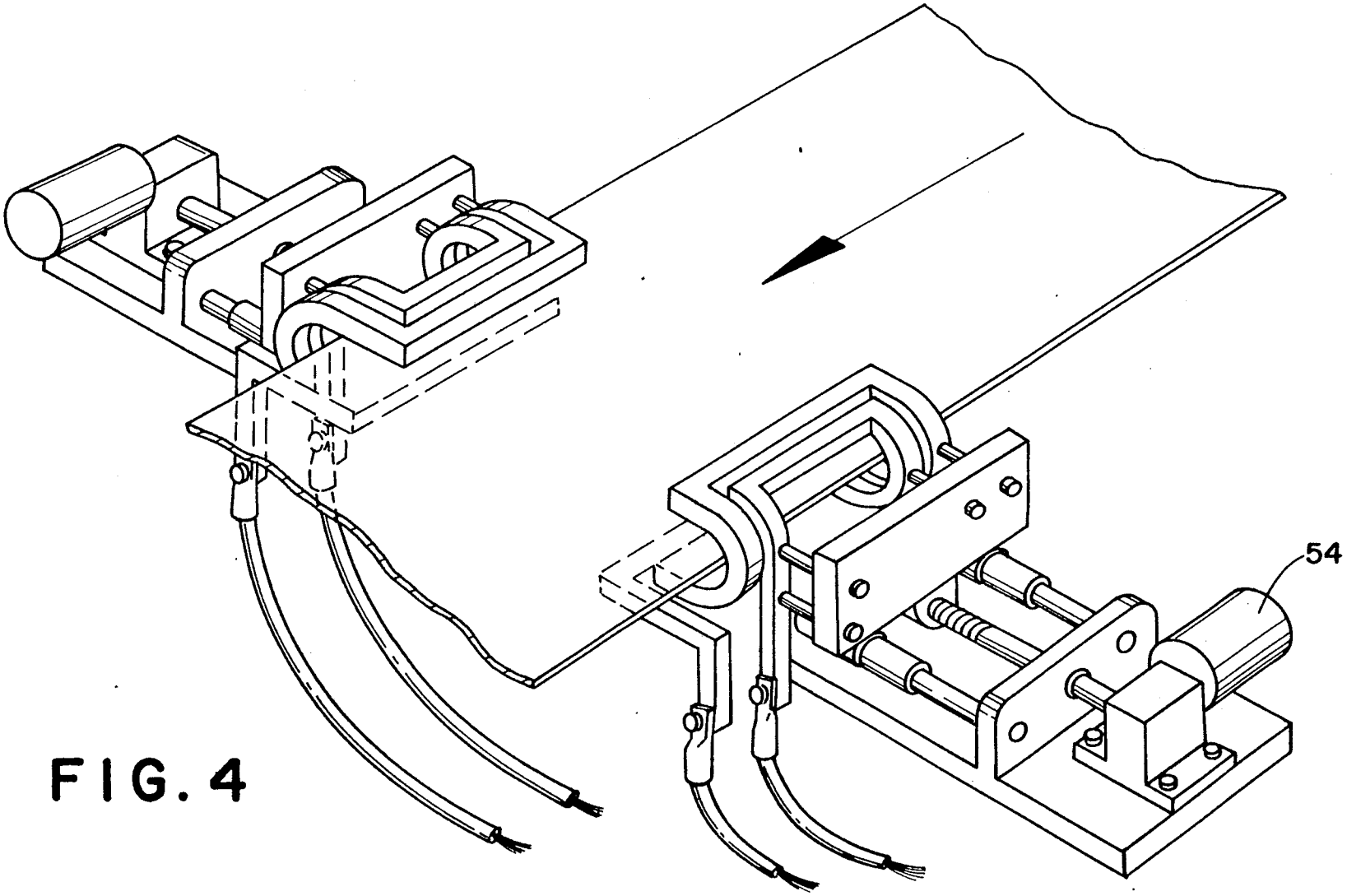
FIG. 4 is a perspective view of a steel strip passing through edge heating coils according to another embodiment of the current invention.
Figure 7:
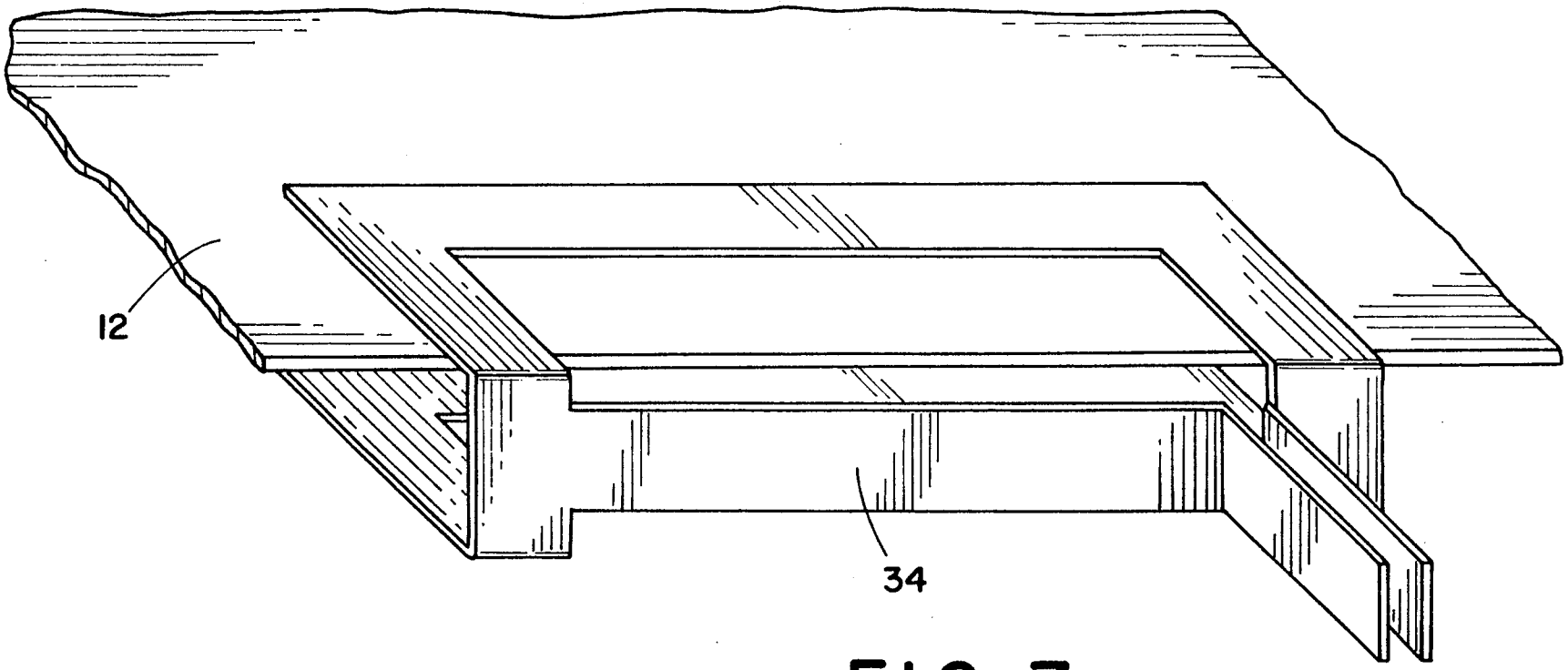
FIG. 7 is a perspective view of a steel strip passing through a preferred embodiment of edge heating coils.

As seen in FIGS. 3 and 4, the edge heating coils are preferably channel-type heating coils 50. The particular geometry of the heating coil will depend on factors unique to the particular application. The preferred geometry for steel strips is shown in FIG. 7. As shown in FIG. 4, the edge heating coils 50 may be mounted to motors to selectively vary the position of the edge heaters with respect to the strip edge. Depending on circumstances unique to each application, such as strip width, strip thickness, and the thickness of the coating on the strip, the position of the edge heating coils relative to the strip edge may be varied, such as by an electric motor 54, to provide optimum temperature uniformity across the width of the strip.

With reference to FIG. 5, an induction heating coil requires an alternating current power supply 26. It is a feature of the invention that the operating frequency of the power supply signal is modulated by a modulator 28. Such a modulated power supply directed to improving the uniformity of a galvannealed product is disclosed in U.S. Pat. No. 4,807,559 to Sommer, et al. It is within the scope of the invention to include frequency or phase modulation of the voltage applied to the induction heating coil to avoid the establishment of a transverse flexural resonance in the strip as it passes through the heating zone of the galvanneal furnace 24. By modulating the frequency of the voltage applied to the coil assembly, the operating conditions throughout the heating zone never stabilize and a resonant response is not produced in the strip.

With reference to FIG. 6, preferably the operating frequency of the power supply signal is modulated by imposing a narrow band frequency modulation on the operating frequency. A typical operating frequency for a galvanneal furnace is 9500 Hz. This type of modulation can be imposed by circuit means such as shown in FIG. 5 by block 28 to provide an oscillating load circuit. Typically such components will comprise variable inductors or capacitors. Such variable components can readily produce frequency modulation (plus or minus 0.75%) on the operating frequency. Alternatively, the frequency modulation can be electronically produced within the power supply. The phase may also be modulated, preferably electronically within the power supply. Examples of detailed circuit assemblies for modulating the phase and frequency of a signal are published within the *Radio Amateur's Handbook*, 36th Ed. (1959), pp. 323–330.

The invention has been described with reference to the preferred embodiments of method and apparatus. Obviously, modifications and alterations will occur to others upon the reading and understanding of the specification. It is our intention to include all such modifications and alterations insofar as they come within the scope of the appended claims or the equivalents thereof.

Having thus described our invention, we now claim:

1. An apparatus for galvannealing a steel strip, comprising:

a bath for applying a rust-inhibiting coating to the steel strip;

air knives for controlling the thickness of the applied coating;

an induction coil assembly for heating the steel strip by magnetic induction to produce an alloy formation at an interface of the coating to the strip;

edge heaters spaced from said induction coil assembly and disposed for heating the edges of the steel strip by magnetic induction to maintain a uniform temperature distribution across the steel strip, the edge heaters having a preselected operating frequency; and, means for modulating the operating frequency whereby undesirable transverse flexural resonance in the galvannealed product is avoided.

2. An apparatus as in claim 1 wherein the edge heaters are disposed before the induction coil assembly, the edge heaters preheating edges of the strip to maintain uniform temperature distribution.

3. An apparatus as in claim 1 wherein the edge heaters are disposed after the induction coil assembly, the edge heaters reheating edges of the strip to maintain uniform temperature distribution.

* * * * *